US006244435B1

(12) United States Patent
Cho

(10) Patent No.: US 6,244,435 B1
(45) Date of Patent: Jun. 12, 2001

(54) CIGARETTE PACKAGE

(76) Inventor: Myong Ho Cho, 205-153, Cheongryang 2-dong, Dongdaemoon-ku, Seoul 130-012 (KR)

( * ) Notice: Subject to any disclaimer, the term of this patent is extended or adjusted under 35 U.S.C. 154(b) by 0 days.

(21) Appl. No.: 09/171,799

(22) PCT Filed: Apr. 29, 1996

(86) PCT No.: PCT/FR96/00062

§ 371 Date: Aug. 23, 1998

§ 102(e) Date: Aug. 23, 1998

(87) PCT Pub. No.: WO96/36538

PCT Pub. Date: Nov. 21, 1996

(30) Foreign Application Priority Data

Apr. 28, 1995 (KR) ..... 95-10778
May 14, 1995 (KR) ..... 95-12170

(51) Int. Cl.[7] ..... B65D 85/10

(52) U.S. Cl. ..... 206/264; 206/273; 229/87.13; 229/240

(58) Field of Search ..... 206/242, 264, 206/265, 268, 271, 273, 484, 484.2; 229/160.1, 160.2, 240, 241, 87.13

(56) References Cited

U.S. PATENT DOCUMENTS

| | | | | |
|---|---|---|---|---|
| 1,516,455 | | 11/1924 | Panza . | |
| 1,785,639 | | 12/1930 | Maurer . | |
| 1,836,228 | | 12/1931 | Dryer . | |
| 2,026,477 | * | 12/1935 | Lescher | 206/264 |
| 2,123,262 | | 7/1938 | Townsend . | |
| 2,252,611 | * | 8/1941 | Bell | 206/264 |
| 2,268,970 | | 1/1942 | Tindal . | |
| 2,330,150 | | 9/1943 | Schweiker . | |
| 2,342,240 | | 2/1944 | Bell . | |
| 2,415,117 | | 2/1947 | Tamarin . | |
| 2,522,868 | | 9/1950 | Goodwin . | |
| 2,588,996 | | 3/1952 | Snyder . | |
| 2,593,778 | | 4/1952 | McGinnis . | |
| 2,675,169 | | 4/1954 | Tamarin . | |
| 2,822,120 | * | 2/1958 | Tamarin | 206/264 |
| 2,844,298 | * | 7/1958 | Tamarin | 206/264 |
| 3,115,293 | * | 12/1963 | Hovland | 206/264 |
| 3,166,233 | * | 1/1965 | Cutler et al. | 206/264 |
| 3,260,405 | * | 7/1966 | Frischer et al. | 206/264 |
| 3,276,668 | * | 10/1966 | Tamarin | 206/264 |
| 4,375,260 | | 3/1983 | Focke et al. . | |
| 4,465,185 | | 8/1984 | Sur . | |
| 4,589,545 | | 5/1986 | Choe . | |

* cited by examiner

*Primary Examiner*—Paul T. Sewell
*Assistant Examiner*—Luan K. Bui
(74) *Attorney, Agent, or Firm*—Morgan, Lewis & Bockius LLP

(57) ABSTRACT

Soft pack of cigarettes having simultaneous opening structure to be removed by a single manipulation of removal of the tear tape and thereby providing direct access to the contents of the package, said opening structure being comprised of outer wrapper, tear tape, inner wrapper having dividing part, and adhesive being provided between said dividing part of the inner wrapper and the outer wrapper and providing firm bond therebetween. Web of outer wrapper having a plurality of outer wrapper for cigarette packs, each of said outer wrapper having extending means connected to the tear tape such that the outer wrapper and dividing part of the inner wrapper of a soft pack of cigarettes can simultaneously be removed by only removing the tear tape. Hard pack of cigarettes having simultaneous opening structure to be opened by a single manipulation of opening of the lid and thereby providing direct access to the contents of the package, said opening structure being comprised of inner frame having opening means and some part of the inner foil wrapper which are adhesively bonded to the inner surface of the front portion of the lid.

9 Claims, 6 Drawing Sheets

Fig.8
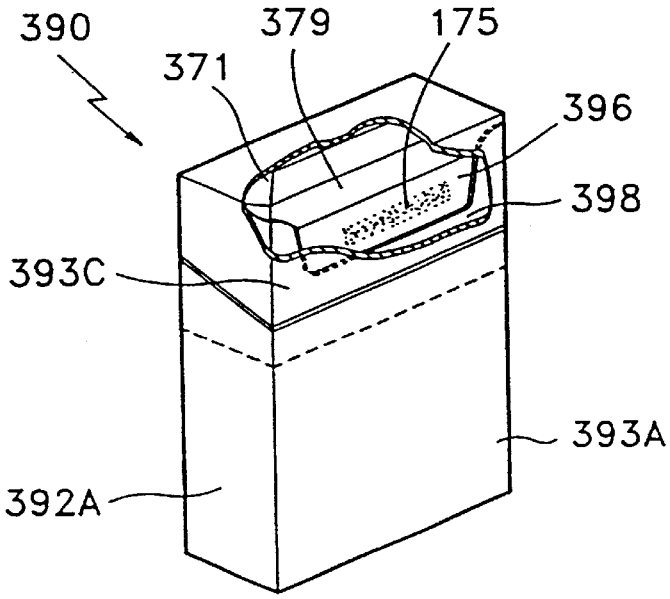
Fig.9
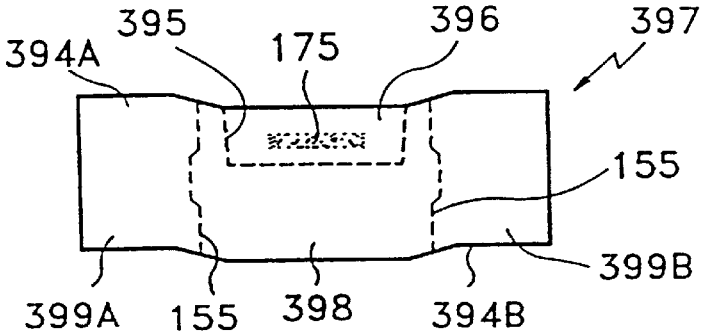
Prior art
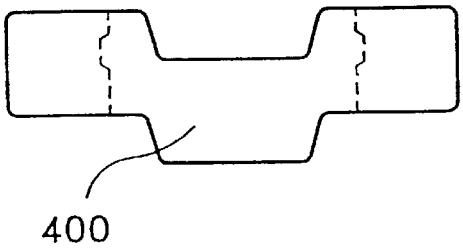
Fig.10

Fig.14
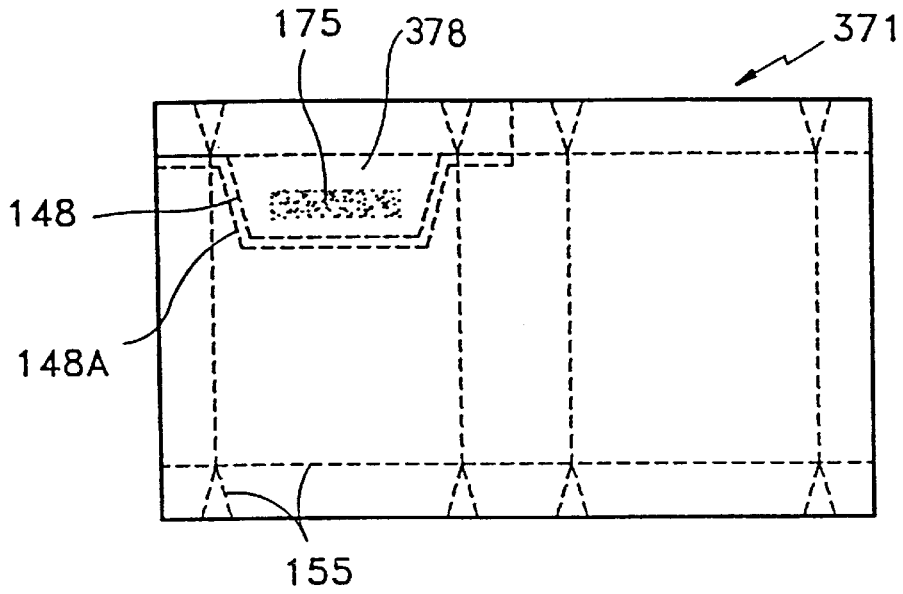
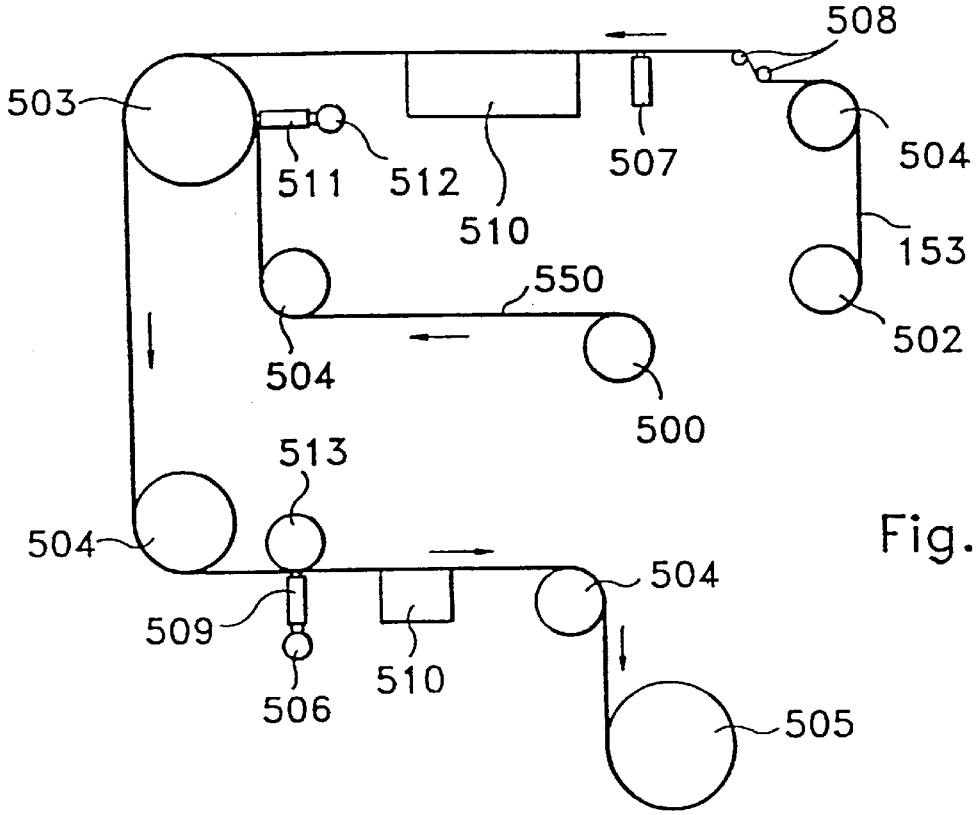
Fig.15

CIGARETTE PACKAGE

TECHNICAL FIELD

The present invention relates to packages, especially relates to packages having simultaneous opening structure of inner and outer wrapping layers of packages comprised of multi-ply wrapping layers.

BACKGROUND OF INVENTION

Cigarettes are generally sold in two types of packs. One type of pack is the so-called "soft pack" in which a group of cigarettes is wrapped in foil wrapper and the foil wrapper is in turn wrapped by a flexible paper wrapper. The second type of pack is a relatively stiff paperboard box having a hinged lid and sometimes referred to as a FLIP TOP ® box.

Both types of packs are typically airtightly circumscribed by a layer of generally transparent, nonporous film of a polymeric material such as polyethylene to maintain cigarette freshness.

By far, when desiring to open said packs of cigarettes, the smoker must manually tear off the upper part of the inner foil wrapper, which has always been unavoidable, tedious and inconvenient task for all the smokers.

DESCRIPTION OF PRIOR ARTS

In the prior arts such as the U.S. Pat. Nos. 1,516,455, 1,785,639, 2,123,262, 2,268,970, 2,330,150, 2,342,240, 2,415,117, 2,522,868, 2,588,996, 2,593,778, 2,675,169, 2,844,298, 4,465,185, 4,589,545, etc., there have been numerous devices, articles, and proposals to conveniently open the inner and outer wrapper and to expose the contents of a package.

However, in use, all these prior arts require the smokers to inevitably go through two steps to open the packs, e.g., first tearing off the tear tape, and second manual removal of some part of the wrappers.

Further, in manufacturing, what is far more important is the possibility to commercialize the invention in light of economy and usefulness.

In this light, as all these prior arts require additional part(s) in manufacturing and two stages in use the articles of the prior arts have serious drawbacks in the inventions themselves and in actuality all these inventions are only devised in vain.

In short, till now, there has been no structure or package which enables the smoker to simultaneously open the inner and outer wrapper of cigarette packs in a single motion of "only pulling the tear tape or lid".

Further, there has also not been any outer wrappers nor webs of outer wrapper which have above said structures for cigarette packages.

OBJECTS OF THE INVENTION

Thus, it is an object of the invention to provide cigarette packs having structures which enable the smoker to simultaneously open the inner and outer wrapper of cigarette packs in a single motion of pulling the tear tape or opening the lid A further object is to provide cigarette packs having simultaneous opening structures which, in manufacturing, require no additional parts, changes of processes, machineries or product lines, or rise of cost.

Still a further object is to provide inner and outer wrappers which have means to form opening structure in combination with other components for cigarette packs.

Still a further object is to provide a continuous web of outer wrapping sheet for cigarette packs having means for simultaneous opening structure.

Still a further object is to provide a method for making a continuous web of outer wrapping sheet for cigarette packs.

BRIEF DESCRIPTION OF THE DRAWINGS

In the drawings, like reference numerals have been used throughout the various figures to designate like or similar elements.

FIG. 8 is a perspective, partly broken view of a hinged lid pack of the invention to indicate the interior construction.

FIG. 9 is a plan view of unfolded blank of the inner frame for a hinged lid pack of the present invention.

FIG. 10 is a plan view of unfolded blank of the inner frame of a hinged lid pack in prior arts and current markets.

FIGS. 13 and 14 are plan views of unfolded inner wrapper for a hinged lid pack of the present invention.

FIG. 15 is a schematic diagram showing the procedure for making the web of outer cellophane film for a soft pack of the present invention.

Figure 1:
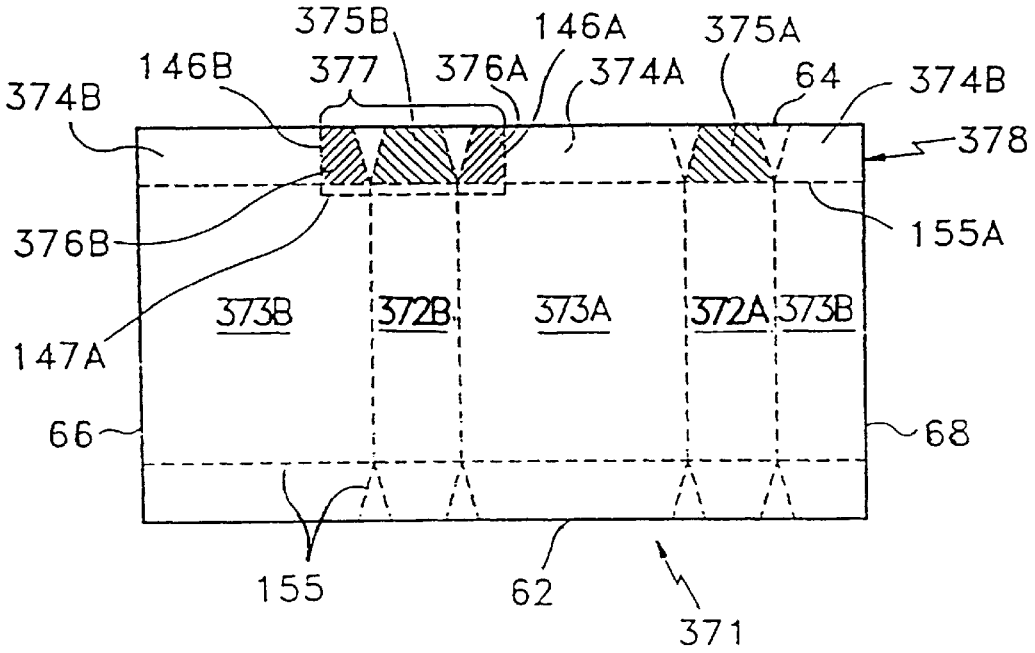
FIG. 1 is a plan view of unfolded inner wrapper for a soft pack of cigarettes of the present invention.

In the drawings, the numeral 155 denotes fold line along which the inner, middle, or outer wrapper will be folded in the usual manner to form a package of cigarettes.

BEST MODES FOR CARRYING OUT THE INVENTION

Generally, a soft pack of cigarettes is wrapped up with an inner metallic foil wrapper 371, a middle flexible paper wrapper 361, and an outer wrapper 381 of generally transparent film of a polymeric material such as polyethylene.

For convenience, the terms "inner wrapper 371", "middle wrapper 361", and "outer wrapper 381", are used to denote the "inner foil wrapper 371", "middle flexible paper wrapper 361", and "outer wrapper 381 of transparent film of a polymeric material", respectively, throughout the specification.

A wrapper is generally folded and encloses a group of cigarettes in the following two modes.

First, the bight of a wrapper will be positioned and form the narrower side of a pack of cigarettes and the overlapping joining folds are positioned at and form the top end closure, a narrower side, and bottom end closure, respectively, which herein referred to as a "side-wrap wrapping". FIGS. 1 and 14 illustrate inner wrappers which will be folded and wrapped in this "side-wrap wrapping" mode.

Figure 13:
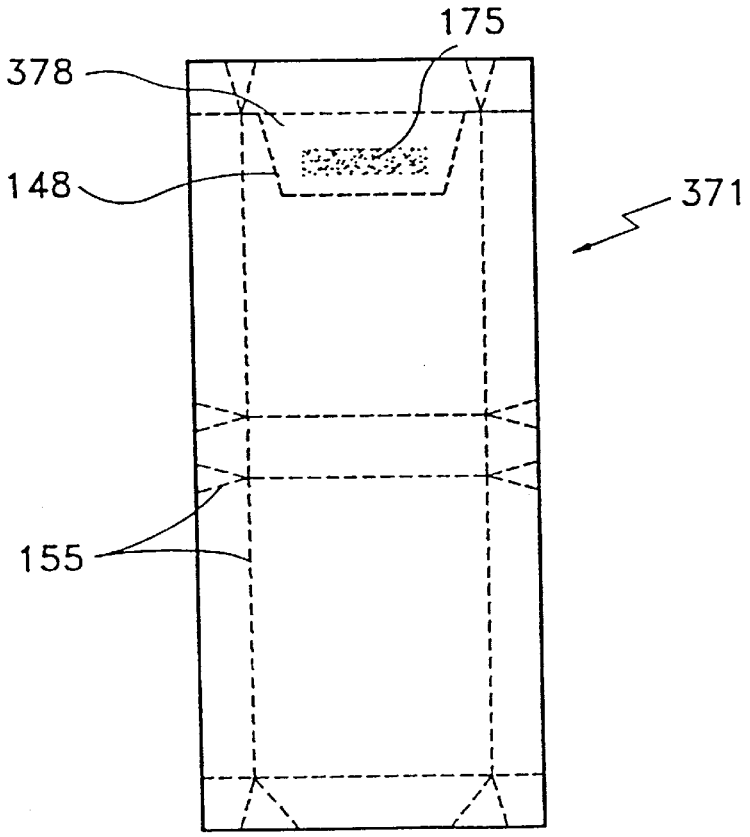

Second, the bight of a wrapper will be positioned and form the narrower bottom end closure of a pack of cigarettes and the overlapping joining folds are positioned at and form the top end closure and both narrower sides, respectively, which herein referred to as a "bottom-wrap wrapping". FIG. 13 illustrates an example of inner wrapper which will be folded and wrapped in this "bottom-wrap wrapping" mode.

In the rectangular wrapping sheets of FIGS. 1 through 7, the numerals 62 and 64 denote the horizontal lower and upper end edge of a wrapping sheet with respect to the longitudinal length, which are opposite and parallel to each other, respectively. And the numerals 66 and 68 denote the vertical left and right end edge of a wrapping sheet, with respect to the longitudinal length, which also are opposite and parallel to each other, respectively.

Generally, in both "side-wrap wrapping" and "bottom-wrap wrapping" mode. the upper extension of an inner wrapper or outer wrapper is folded along the fold lines so as to form a top end closure composed of tucks and flap sections.

In other words, the extensions of the narrower sides of a wrapper are folded to form tucks and those of the wider sides of a wrapper are folded to form flaps. The tucks overlie the end of filters of cigarettes(or some part of the top end closure of inner wrapper) and are overlaid by the flaps, and thereby the tucks and flaps form a top end closure.

Thus, the term "tuck" designates the portion of the top end closure formed from a folded-down extension of the part of the inner wrapper or outer wrapper positioned on one of the narrower side walls of a pack of cigarettes.

In ordinary pack of cigarettes, bottom extensions of the inner, middle, and outer wrapper may be folded in any usual way to form bottom end closures, respectively. After the upper extension 378 of the inner wrapper 371 is downfolded to form a top end closure 379 and a sealing strip 380 of paper or polymeric material is attached, across the top end closure 379, to the middle wrapper 361, the pack is enclosed in an outer wrapper 381 having a tear tape 153. The upper extension 388 of the outer wrapper 381 is also downfolded to form a top end closure 389.

On the whole, in present invention, a dividing part 377 enclosed by lines of perforations is formed on the inner wrapper 371, and adhesive is applied between the outer surface of the dividing part 377 and the inner surface of the tuck of the outer wrapper 381, such that, when the smoker removes the top end closure 389 of the outer wrapper 381 by pulling the tear tape, the dividing part 377 of the inner wrapper 371 is simultaneously removed together with the top end closure 389 of the outer wrapper 381. Thus, the smoker can gain direct access to the cigarettes in the package by a single manipulation of removing of the tear tape.

The structure and role of the inner wrapper 371 are as follows.

Generally, the rectangular inner metallic foil wrapper is comprised of a layer of paper and metallic material layer such as silver pigment coated thereon.

In FIG. 1, the numerals 373A and 373B denote the wider parts of the inner wrapper 371 which will be placed on the wider fore and rear side of the pack of cigarettes, respectively, and the 372A and 372B denote the narrower parts which will be placed on the narrower left and right side thereof, respectively, when the inner wrapper 371 is folded and filled with cigarettes to form a pack.

The upper extension 378 of the inner wrapper 371 is folded along the conventional fold line 155 so as to form a top end closure 379 composed of tucks 375A and 375B and flap sections 374A and 374B. The numerals 376A and 376B denote some part of the flap sections 374A and 374B, respetively, which partially overlie the tuck 375B, and referred to herein as overlying parts 376A and 376B.

The inner wrapper 371 has dividing part 377 which is formed of any one of the tucks 375A and 375B of the inner wrapper 371 and some parts of the flaps which are integrally extending parts of the tuck, the details of which are as follows.

As described, the upper extension 378 of the inner wrapper 371 in FIG. 1 is comprised of tucks and flaps which will be folded and forms the top end closure of the inner wrapper for a soft pack of cigarettes.

The upper extension 378 has dividing lines 146A, 146B and 147A formed of a series of perforations. The dividing line may also be formed of a series of slits.

The horizontal dividing line 147A is provided being parallel to and coincident with or adjacent to the upper horizontal fold line(155A in FIG. 1), at the point where the tuck 375B is folded.

Two vertical dividing lines 146A and 146B are provided on the flaps 374A and 374B, respectively. Said dividing lines 146A and 146B are, respectively, formed to be coincident with or adjacent to the end edge of the tuck 375B, or coincident with or adjacent to the marginal edge of the sealing strip 380 when said tuck and flaps are folded and overlaid by said sealing strip 380.

Each of the dividing lines 14CA and 146B extends from the upper end edge 64 to the dividing line 147A. Thus, the dividing line 147A extends perpendicular to and between the vertical dividing lines 146A and 146B.

The numeral 377 denotes the dividing part enclosed by the dividing lines 146A, 146B and 147A. Thus, the dividing part 377 can easily be removed from the inner wrapper 371 along the dividing lines 146A, 146B and 147A.

When inner wrapper is wrapped in the "bottom-wrap wrapping" mode, in the similar manner as that shown in FIG. 13, the overlapping joining folds of the marginal edge part of the inner wrapper are positioned on both narrower sides of the pack. Accordingly, the upper extension(tuck) of the narrower sides are also formed of the overlapping joining folds.

In this case, however, the dividing part 377 may also be formed in the same above described manner.

In order to let the dividing lines be invisible or to prevent the light, air or moisture to pass therethrough to maintain the freshness of the cigarettes, synthetic resin materials, pigments, additives, minerals or any other known materials may be coated, applied, or laminated along the dividing lines of the inner wrapper 371.

If the dividing line 147A is positioned a little lower than the fold line 155 as shown in FIG. 1, and if the dividing lines 146A and 146B are so positioned to be a little overlaid by the sealing strip 380 that the areas of these overlying parts engaged by the sealing strip 380 may be readily drawn from beneath the sealing strip for being detached along the dividing lines 146A and 146B, the dividing lines 146A, 146B, and 147A are invisible and the middle wrapper 361 and sealing strip 380 help prevent the light, air or moisture to pass through the dividing lines.

Namely, the dividing lines 146A, 1461B, and 147A may optionally be so provided in the inner wrapper 371 that the dividing lines 146A, 146B, and 147A may be overlaid by the scaling strip 380 and the middle paper wrapper 361 when the inner wrapper 371 is folded, the middle wrapper is wrapped and the sealing strip 380 is attached to form a pack.

As described, the inner metalic foil wrapper 371 is comprised of a layer of paper and, metallic material layer.

Thus, if the adhering strength of the adhesive 175 applied between the foil surface of the inner wrapper 371 and the inner surface of the outer wrapper 381 is stronger than the adhering strength of the coating of metallic material to the surface of paper layer, only the foil surface of the inner wrapper 371 may be peeled off instead of the whole dividing part 377 of the inner wrapper 371 when the top end closure 389 of the outer wrapper 381 is removed by the tear tape.

Thus, the surface of the dividing part 3. 9f the inner wrapper 371 may optionally be formed to have no coating of metallic material applied thereto.

Figure 2:
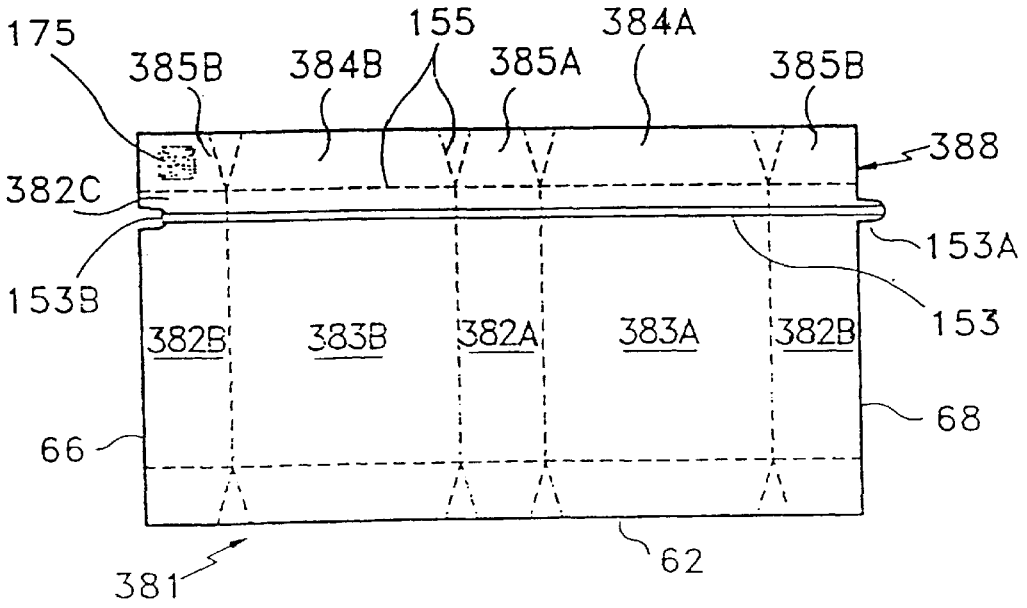
FIGS. 2 through 4 are plan views of unfolded outer cellophane wrapper for a soft pack of cigarettes of the present invention.

FIG. 2 illustrates an outer wrapper 381 of polymeric metallic material such as polyethylene film, in which a "tear tape 153", i.e., a narrow strip generally of a polymeric material such as polypropylene, is provided to the inner side of the wrapper 381.

Said tear tape 153 is attached to, in parallel with and spaced inwardly from one of horizontal end edges of the outer wrapper 381 in the similar manner as that for the conventional wrapping sheet.

Thus, when the wrapper 381 wraps a package, the tear tape 153 is interposed between the package and the outer wrapper 381 and protrudes the wrapper 381 to allow a smoker to slit the wrapper 381 and open the package.

Figure 3:
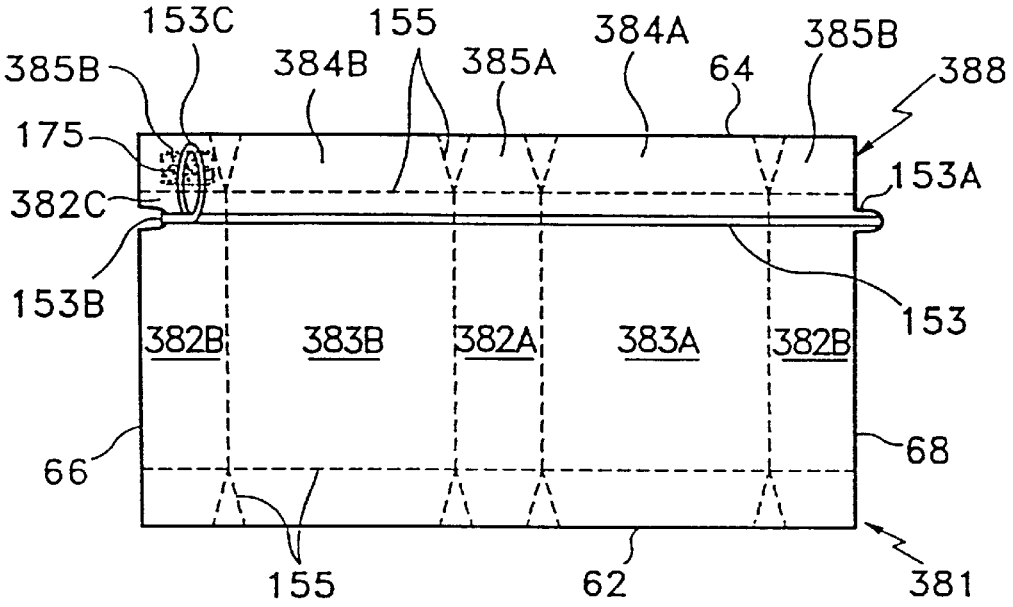
Figure 4:
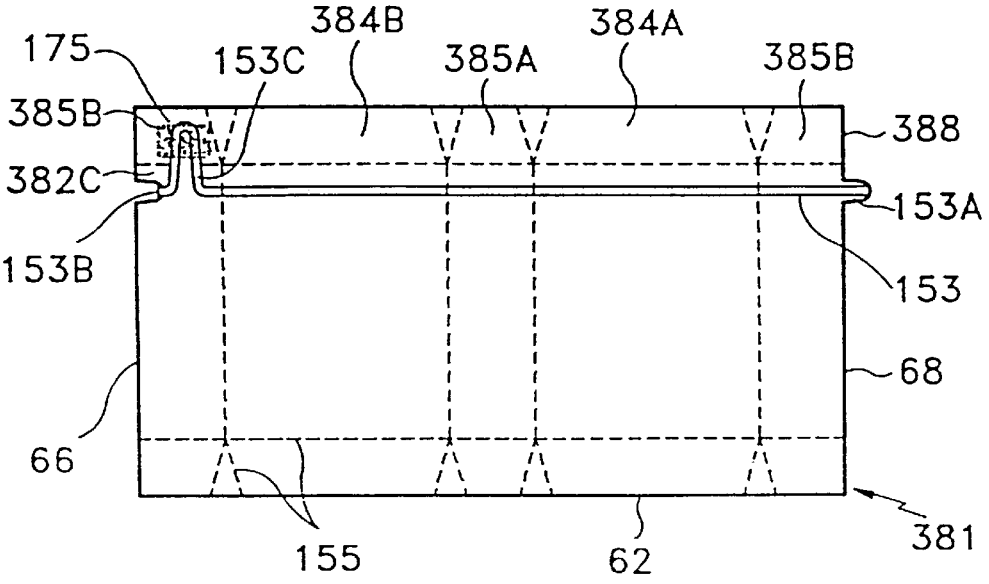

In FIGS. 2 through 4, the numeral 153A denotes the beginning part of the tear tape 153 which protrudes out a little from the end edge 68 of the outer wrapper 381 and the numeral 153B denotes the end part of the tear tape 153.

And, the areas of the beginning part and end part of the tear tape 153 are generally more strongly adhered to the outer wrapper 381 than any other part of the tear tape in order to facilitate the tearing operation.

Figure 5:
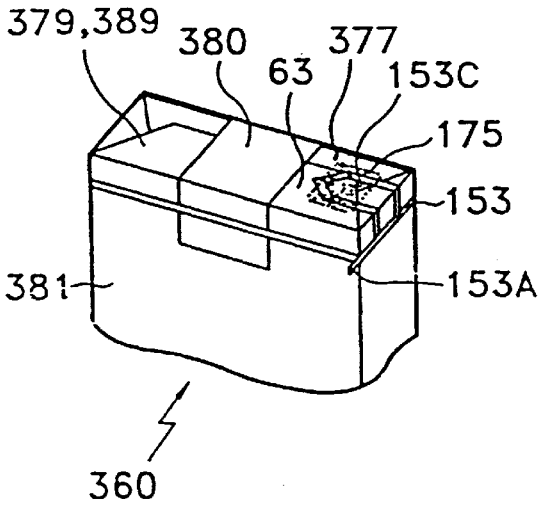
FIG. 5 is a perspective, partly broken view of a soft pack embodying the present invention.

As shown in FIG. 5, the tear tape 153 encircles the cigarette package 360 inside the outer wrapper with the beginning part 153A thereof protruding from the inside of the outer wrapper to the exterior thereof through the overlapping joining fold of the wrapper.

In FIGS. 2 through 4, the numerals 383A and 383B denote the wider parts of the outer wrapper 381 which will be placed on the wider fore and rear side of the pack of cigarettes, respectively, and the 382A and 382B denote the narrower parts which will be placed on the narrower left and right side thereof, respectively, when the outer wrapper 381 is folded and wraps a pack.

The upper extension 388 of the outer wrapper 381 is folded along the conventional fold line 155 so as to form a top end closure 389 composed of tucks 385A and 385B and flap sections 384A and 394B. In detail, the upper extensions of the wider sides 383A and 383B of the outer wrapper 381 form the flap sections 384A and 38AB, and the upper extensions of the narrower sides 382A and 382B of the outer wrapper 381 form the tucks 385A and 385B.

The part 382B at left side part of the outer wrapper 381 and the part 382B at right side part thereof are overlapped to each other and are placed on any one narrower side of a pack of cigarettes. And the upper extension of the overlapping joining folds of the marginal edge parts 382B of the outer wrapper 381 is folded and forms the tuck 385B.

Conventionally, the joints formed by the tucking, folding and enclosing of the outer wrapper 381 are airtightly sealed by the action of heating and/or pressing and/or bonding metallic material applied to the surfaces thereof. The details of the first embodiment of soft pack of cigarettes of the invention is as follows.

First, the inner wrapper 371 in FIG. 1 is folded and filled with cigarettes to form a pack and the upper extension 378 of the inner wrapper 371 is folded along the conventional fold line 155 so as to form a top end closure 379 composed of tucks 375A and 375B and flap sections 374A and 374B.

Second, the middle wrapper 361 wraps the pack wrapped up with the inner wrapper 371 and the sealing strip 380 is attached, across the top end closure 379, to both extremities of the middle wrapper 361.

Third, a portion of adhesive 175 is provided between the outer surface of the folded dividing part 377 (the surfaces of the overlying parts 376A and 376B and some area of the tuck 375B) and the inner surface of the tuck 385B of the outer wrapper 381.

Fourth, the pack is enclosed in an outer wrapper 381 having an ordinary tear tape 153. The upper extension 388 of the outer wrapper 381 is also downfolded to form a top end closure 389.

And fifth, by the action of heat and/or pressure of the instrumentality (not shown) for effecting the sealing of the joints of the top end closure 389 of the outer wrapper 381, the adhesive 175 simultaneously bonds the inner surface of the tuck 385B of the outer wrapper 381 to the outer surface of the folded dividing part 377 of the inner wrapper 371.

Figure 6:
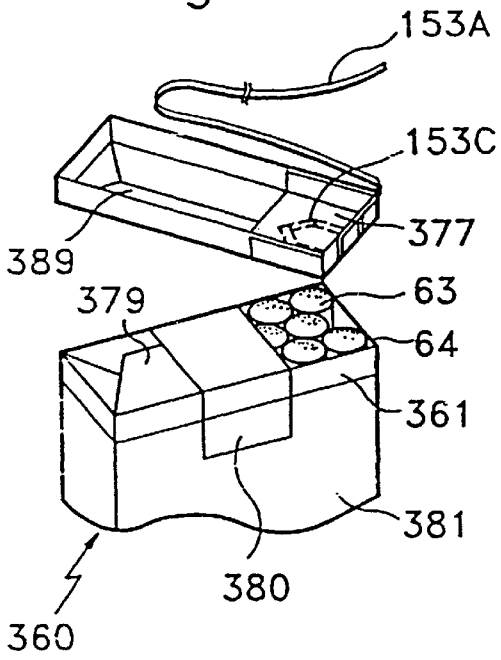
FIG. 6 is a perspective, partly broken views of the soft pack in FIG. 5 with the top end closure being opened by the tear tape and thereby the contents of the pack being exposed.

Consequently, in the similar manner as that shown in FIG. 6, when the top closure 389 of the outer wrapper 381 is removed from the remainder of the outer wrapper by pulling the tear tape 153, the dividing part 377 of the inner wrapper 371 adhered to the top closure 389 is simultaneously lifted together with the top closure. 389 and the tear tape 153. Said adhesive 175 may be any one of the nontoxic, pressure sensitive permanent adhesive, dried heat-activating adhesive or glue, or any other known nontoxic, tacky, cohesive metallic material.

For example, a solution or dispersion of a thermoplastic adherent metallic material such as a vinyl compound in a volatile solvent, which, on drying, leaves non-tacky thermally activatable bonding metallic material may be adapted as the adhesive 175.

The adhesive 175 between the inner surface of the outer wrapper 381 and the outer surface of the folded dividing part 377 of the inner wrapper 371 may be provided in three ways.

First, in the midst of wrapping processes, the adhesive 175 may be applied to the outer surface of the folded dividing part 377 of the inner wrapper 371 just right before the tuck 385B of the outer wrapper 381 overlies the surfaces of the outer surface of the folded dividing part 377 of the inner wrapper 371.

Second, the inner surface of the tuck 385B of the outer wrapper 381 may first be coated with adhesive 175 preferably when the outer wrapper 381 is manufactured, and may overlie and adhere to the outer surface of the folded dividing part 377 of the inner wrapper 371.

And third, the adhesive 175 may be applied to the outer surface of the unfolded dividing part 377 of the inner wrapper 371 preferably when the inner wrapper 371 is manufactured.

FIGS. 2, 3, and 4 show examples of the adhesive 175 applied to the inner surface of the tuck 385B of the outer wrapper 381.

Currently, the transparent outer wrapper for cigarette packs is mostly sealed with thermal pressing to keep airtight.

Thus, if the adhesive 175 preferably having dried, thermally activatable bonding properties is precoated on the inner surface of the tuck 385B of the outer wrapper 381, or on the outer surface of the dividing part 377 of the inner wrapper 371, the tuck parts 375B and 385B of both wrapper 371 and 381 may easily be adhered to each other without additional appliances, machineries, or processes for the provision of adhesive therebetween.

It is preferable that the adhesive 175 is so provided between the inner surface of the outer wrapper 381 and the outer surface of the folded dividing part 377 of the inner wrapper 371 that the adhesive 175 may not spread out beyond the whole outer surface of folded dividing part 377 of the inner wrapper 371.

Namely, the area of the adhesive 175 between the inner surface of the outer wrapper 381 and the outer surface of the folded dividing part 377 of the inner wrapper 371 is so formed as to be placed in the middle of the folded dividing part 377 of the inner wrapper 371, such that the adhesive 175 may not be provided to the exterior of the dividing lines 146A and 146B, and the fold line 155A.

As described, when the top closure 389 of the outer wrapper 381 is removed by pulling the tear tape 153, the dividing part 377, of the inner wrapper 371 adhered to the top closure 389 is simultaneously lifted together with the top closure 389.

In this case, the inventor has found that;

first, when the tear tape 153 is pulled straight forwardly(to the direction parallel to the tear tape), the top closure 389 together with the dividing part 377 may not easily be removed out from the pack 360, second, when the tear tape is pulled straight upwardly(to the direction perpendicular to the tear tape), the top closure 389 of the outer wrapper 381 together with the dividing part 377 may or may not be removed from the pack 360 according to the interrelationship between the tensile strength and adhering strength of the tear tape, adhesive, the wrappers, and etc.

and third, if the tensile strength of the part 382C of the outer wrapper 381 in FIG. 2 (the part between the end part 153B of the tear tape 153 and the tuck 385B; herein referred to as connecting part 382C) is weaker than that of the dividing lines 146A, 146B and 147A of the inner wrapper 371 which connect the dividing part 377 to the remainder of the body of the inner wrapper 371, the top closure 389 together with the dividing part 377 can not be removed from the pack 360 in a single motion of pulling the tear tape 153.

The factors that influence the removal of the top closure 389 together with the dividing part 377 from the pack 360 are as follows:

1) adhering strength of the tear tape 153 to the outer wrapper 381 (herein designated as "T"),
2) tensile strength of the connecting part 382C of the outer wrapper 381 (herein designated as "O"),
3) the adhering strength of the adhesive 175 applied between the foil surface of the inner wrapper 371 and the inner surface of the outer wrapper 381 (herein designated as "A"),
4) adhering strength of metallic foil layer on the surface of the paper layer comprising the inner wrapper 371 to the paper layer of the inner wrapper 371 (herein designated as "M"),
5) tensile strength of the dividing lines 146A, 146B and 147A of the inner. wrapper 371(herein designated as "D").

Thus, the embodiments of the present invention is formed to have the following relationship between these factors;

$$T>O\geqq A\geqq M>D$$

According to my experiments, among these factors T, O, A and M, as the connecting part 382C of the outer wrapper 381 may have the most weak strength("O"), the strength D should be less than the strength O in order to remove the top closure 389 together with the dividing part 377 from the soft pack 360 in a single motion of pulling the tear tape 153.

Thus, in present embodiment, it is preferable that the adhesive 175 and the dividing lines 146A, 146B and 147A are so provided to the inner wrapper ancvor outer wrapper that the strength T may be stronger than the strength O, the strength O may be stronger than or equal to the strength A, the strength A may be stronger than or equal to the strength M, and the strength M may be stronger than the strength D.

Further, the present invention provides quite a new outer wrappers 381 having extending means which connects the tear tape 153 and the tuck 385B of the outer wrapper 381.

The extending means intended to help the smoker perfectly remove the top closure 389 of the outer wrapper 381 together with the dividing part 377 of the inner wrapper 371 by a single manipulation of removal of the tear tape.

As an example, a narrow and short strip preferably having the same properties as those of the tear tape 153 is separately prepared and provided to an outer wrapper 381 as extending means 153C.

Figure 7:
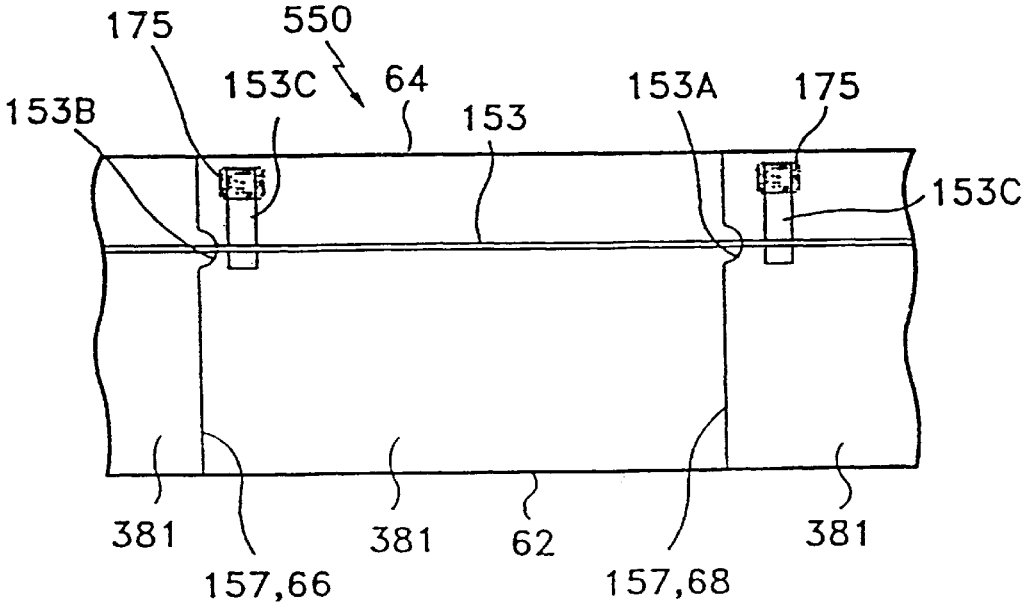
FIG. 7 is a perspective view of a web of outer cellophane wrapper for a soft pack of the present invention.

In FIG. 7, an end of the extending means 153C is interposed between the outer wrapper 381 and tear tape 153, and extends, across the tuck 385A or 385B, to the upper end edge 64.

As described, the upper extensions of the narrower sides 382A and 382B of the outer wrapper 381 form the tucks 385A and 385B. In FIGS. 3 through 7 the extending means are provided at the tuck 385B. However, it may be formed at the tuck 385A, on the extension of the narrower side 382A.

As is well known in the art, the areas of the beginning part 153A and end part 153B of the tear tape 153 are more strongly adhered to the outer wrapper 381 than any other part of the tear tape 153 in order to facilitate the tearing operation.

Likewise, the extending means 153C is strongly, integrally, adhered to the outer wrapper 381, the tear tape 153 and the tuck 385B of the outer wrapper 381 by the same means and methods such as heating, pressing and/or applying of bonding material as those well known in the art.

Further, as described, the inner surface of the tuck 385B of the outer wrapper 381 and the outer surface of the dividing part 377 of the inner wrapper 371 are integrally adhered to each other by the adhesive 175.

Thus, as shown in FIG. 5, the adhesive 175 also integrally bonds the extending means 135C, the inner surface of the tuck 385B and the outer surface of the dividing part 377 to one another.

In FIGS. 3 and 4, the tear tape 153 itself, at the end part 382B of the outer wrapper 381, near the end part 153B of the the tear tape 153, extends upwardly, across the tuck 385B, forming the shape of a loop and a "Λ" shaped arch, near to the upper end edge 64 of the outer wrapper 381, and forms the extending means 153C, respectively.

Consequently, as the tear tape 153 extends to the tuck part 385B of the outer wrapper 381 by means of extending means 153C which is strongly adhered to both the dividing part 377 of the inner wrapper 371 and the tuck 385B of the outer wrapper 381, the smoker can perfectly remove the top closure 389 of the outer wrapper 381 together with the dividing part 377 of the inner wrapper 371 by a single manipulation of removing of the tear tape.

FIG. 6 is a perspective, partly broken view of a soft pack of the invention with the inner and outer wrapper slit into two pieces by a single motion of tearing of the tear tape and thereby the contents of the pack being exposed.

This embodiment well represents the characteristic feature of the present invention. In case of most packs of cigarettes in current markets, the joints of the outer wrapper is sealed by the action of heat and/or pressure of the instrumentality.

Thus, in producing the packs of the invention, almost no additional changes, developements, appliances, or facilities are required. Instead, with only the provision of dividing lines, adhesive, ancvor the extending means to the inner foil wrapper and/or the outer wrapper, the packs of the invention will be readily adaptable to machine wrapping on existing types of wrapping machines.

A further embodiment of the invention provides a web of polymeric material having a plurality of the outer wrappers 381 shown in FIGS. 2, 3, and 4 and described in connection therewith.

A longitudinally extending web of polymeric metallic material having opposite parallel upper and lower edges has a narrow tear tape strip of polymeric material attached thereto. Said tear tape is in parallel with and spaced inwardly from said upper end edge of the web.

A portion of adhesive 175 and/or extending means 153C are so repeatedly, at regular intervals, provided or formed between the tear tape and the upper end edge of the web 550 that said portion of adhesive 175 and/or extending means 153C may be provided on each of the outer wrappers 381 when each outer wrapper 381 is severed from the web 550 along the cutting line.

Thus, each of said consecutive wrapping sheets 381 is connected at the cutting lines 157 to the other wrapping sheet 381.

The cutting line 157 is so provided as to form protruding beginning part 153A and corresponding recessed end part 153B of the tear tape 153 when each outer wrapper 381 is severed from the web 550 along the cutting line 157, which is well known in the art.

In FIG. 7, the outer wrapper 381 is shown as one of a plurality of such wrapper in a longitudinally extending web 550, the additional outer wrapper 381 being illustrated adjacent opposite ends of the outer wrapper 381 and the transverse cutting lines 157 for one complete wrapper will divide the web 550 into several sheets of outer wrapper 381.

The extending means repeatedly, at regular intervals, provided to the web 550 may be any one of above described a loop shaped extending means, a "Λ" shaped extending means, or a narrow and short strip of extending means being separately prepared and attached to the web 550.

It is well known in the art that a continuous sheet of outer wrapper film and a continuous strip of tear tape are separately provided to cigarette wrapping machine, combined to each other in said wrapping machine in the course of wrapping, and each outer wrapper having tear tape is cut to wrap a pack of cigarettes.

Thus, the extending means 153C may be attached or formed, in the wrapping machine in the course of wrapping, to the continuous sheet of outer wrapper and tear tape, and then each outer wrapper 381 having tear tape and extending means may be cut to wrap a pack of cigarettes.

Further, a web of continuous sheet of outer wrapper 381 of the present invention having tear tape and/or extending means may be separately manufactured and provided to cigarette wrapping machine, and then each outer wrapper 381 having tear tape and extending means may be cut to wrap each pack of cigarettes.

In any cases, in order to wrap each pack of cigarettes, each outer wrapper 381 having tear tape 153 and extending means 153C is finally cut in the cigarette wrapping machine in the course of wrapping.

FIG. 15 shows an example of the methods and procedures forming a separate web 550 of outer wrapper having extending means 153C and/or adhesive 175, and an example of the continuous sheet material 550 of wrapping sheet having tear tape 153 and extending means 153C being cut by a cutter in the cigarette wrapping machine is described and shown in my previous application claiming priority(in lines 8 to 12 of sheet number 10 of the description and FIG. 17 of the drawing of the Korea Patent Application No 1995-12170, filed May 14, 1995).

In FIG. 15, a continuous sheet metallic material 550 of wrapping sheet comes from the reel 500 and a continuous strip of tear tape 153 comes from the reel 502, and the sheet 550 and the tear tape 153 go over the roll 503, and reaches the web 505. The feeder 511 revolving on the shaft 512 is arranged to feed short strips 153C of, extending means to the sheet metallic material 550. The adhesive feeder 509 applies adhesive 175 on the tuck part of each outer wrapper 381.

Instead of the feeder applying extending means of separate short strips, different feeder or former may be installed to provide a loop or an arch shaped extending means formed of the tear tape itself. The adhesive feeder 509 may optionally not be installed.

Figure 11:
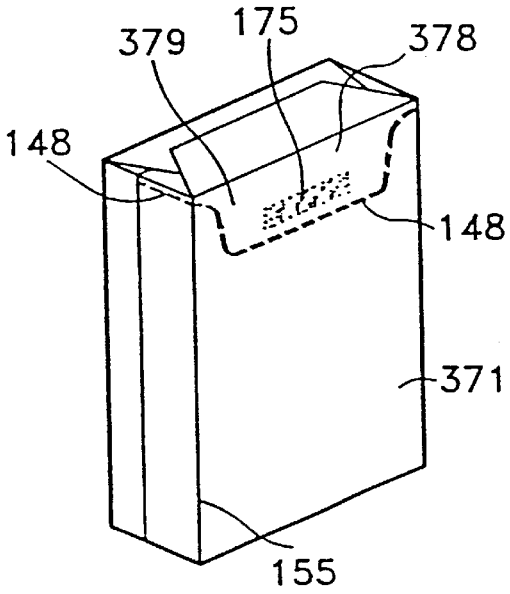
FIG. 11 is a perspective view of an inner foil wrapper wrapping a plurality of cigarettes and thereby forming a body for a hinged lid pack of cigarettes.
Figure 12:
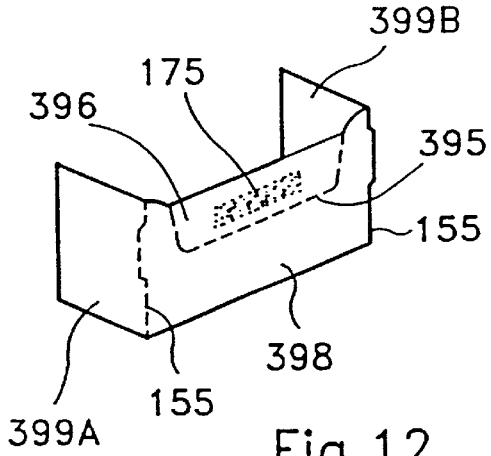
FIG. 12 is a perspective view of the inner frame in FIG. 9 with the side panels 399A and 399B being bent back to extend normally from the front panel 398.

A further embodiment of the present invention relates to simultaneous opening structure for hinged lid pack of cigarettes. A hinged lid pack for cigarettes is commonly made from two blanks, one blank forms the lid and body of the pack, and the other blank, herein referred to as the inner frame, is mounted inside the body and forms an extension of the top of the body, against which the inside of the lid bears frictionally when closed. A foil wrapper is wrapped around the cigarettes as shown in FIG. 11) in the hinged lid pack.

With the conventional hinged lid packs, after opening the lid, the smoker must manually tear off the upper part of the inner foil wrapper, which, though being slit, also is unavoidable, tedious and inconvenient task for the smokers.

FIG. 8 is a perspective, partly broken view of a hinged lid pack 390 of the invention to indicate the interior constriction.

According to the present invention there is provided a hinged lid pack 390 comprising; a body having a back wall, a front wall 393A, a pair of side walls 392A, and a base, a lid having front portion 393C and side portions, and a rear portion hinged to said back wall.

FIG. 9 illustrates a cut bank of inner frame 397 having a pair of side panels 399A, 399B, and a front panel 398 which are mounted respectively against the inside of the side walls 392A and front wall 393A and which project upwardly beyond the level of said rear wall 393B so as to bear frictionally inside of the lid when closed.

FIG. 11 illustrates the inner frame 397 with the side panels 399A and 399B being bent back to extend normally from the front panel 398.

The front panel 398 of the inner frame 397 has a "U" shaped dividing line (preferably of slits or perforations) 395 to allow removal of the part 396 from the front panel 398 and thereby to provide a recess which allows direct access to the cigarettes in the pack.

The bottom of the "U" shaped dividing line 395 is placed to be coincident with or a little upwardly apart from the upper end of the front wall 393A of the body when the inner frame 397 is included in a pack.

In this embodiment, the term "opening means 396" is used to denote the part 396 enclosed by the "U" shaped dividing line 395 of the front panel 398 of the inner frame 397.

In current markets, the blank for the inner frame in a hinged lid package is made from a continuous strip of cardboard material, and in order to make the blank economically without wasting metallic material, the top and bottom profiles of the blank are made to be of the same shape, so that one blank will nest into another as shown in FIG. 10. For this reason the front panel of the conventional inner frame has a downwardly dependent tab 400 in FIG. 10 which corresponds with the shape of the cut-out above it. However, this downwardly dependent tab is only another type of waste of resources in that it does do no significant roles.

The top and bottom profiles of the inner frame 397 of the present invention are also made to be of the same shape, so that one blank will nest into another as shown in FIG. 9.

However, in present invention, the inner frame 397 has no such downwardly dependent tab. Instead, the inner frame 397 not only has the same top and bottom profiles but also provides a useful means to simultaneously open the pack.

A portion of adhesive 175 is applied to the middle part of the opening means 396. The adhesive 175 is to adhere the opening means 396 to the inner surface of the front portion 393C of the lid when the lid is closed to form a pack of cigarettes.

Said portion of adhesive 175 may optionally be provided to the separate blank of the inner frame or to the folded inner frame in the course of wrapping a pack.

FIG. 11 is a perspective view of the inner foil wrapper wrapping a group of cigarettes and thereby forming a body for a hinged lid package. As shown in FIGS. 11, 13, and 14, on the upper part of any one of the wider sides of the inner wrapper 371 there is also provided a "U" shaped dividing line 148 of slits or perforations, to allow removal of the part 378 from the inner wrapper 371 and thereby to provide a recess which allows access to the cigarettes in the pack.

In this embodiment, the term "opening part 378" is used to denote the part 378 enclosed by the "U" shaped dividing line 148 provided on the upper part of any one of the wider sides of the inner wrapper 371.

The "U" shaped dividing line 148 of the inner wrapper 371 is preferably formed to be coincident with the "U" shaped dividing line 395 of the inner frame 397 when the inner frame 397 overlies the pack wrapped by inner wrapper 371 such as shown in FIG. 11. However, the "U" shaped dividing line 148 may be formed not to be coincident with the "U" shaleld dividing line 395 of the inner frame 397 to help keep the freshness of the cigarettes. The line 148A in FIG. 14 is drawn to show an example of the dividing line 148 which is formed not to be coincident with the "U" shaped dividing line 395 of the inner frame 397.

A portion of adhesive 175 is also applied to the outer surface of the middle part of the opening part 378 of the inner wrapper 371, and thereby firmly adheres the opening part 378 to the opening means 396 of the inner frame 397.

Said portion of adhesive 175 may also optionally be provided to a separate sheet of the inner wrapper or to the folded inner wrapper in the course of wrapping.

The pressure and/or heat conventionally used in forming a hinged lid pack will naturally press and/or heat the portions of adhesive between the front portion 393C of the lid, the opening means 396 of the inner frame 397 and the opening part 378 of the inner wrapper 371, respectively, and thereby cause a tight bond to be formed therebetween.

Thus, as the adhesive 175 on the opening means 396 firmly bonds the opening means 396 to the inner surface of the front portion 393C of the lid and the adhesive 175 on the opening part also firmly bonds the opening part 378 to the opening means 396, the opening part 378 and opening means 396 can be removed altogether with the lid when the smoker opens the lid.

As further specific advantages of the invention, in manufacturing the packages of the invention, no special parts, means, or articles are required and no additional operations, processes, appliances, machineries, facilities, or product lines are required at all.

In the preferred embodiments of the invention, the packages are packs of cigarettes. However, the articles, parts, and/or methods described in this specification can also he applied to other packages for other products such as chocolates, biscuits, and the like.

It is believed that the invention will have been clearly understood from the foregoing detailed description of preferred embodiments. Changes in the details may be resorted to without departing from the basic concept of the invention. And it is accordingly intended that no limitation be implied and that the hereto annexed claims be given the broadest interpretation to which the employed language fairly admits.

What is claimed is:

1. A soft pack of cigarettes being wrapped up with an inner metallic foil wrapper, a middle flexible paper wrapper, and an outer wrapper of transparent film of a polymeric material, comprising:

a rectangular inner metallic foil wrapper comprised of a layer of paper and metallic material layer, having wider parts and narrower parts which will be placed on the wider fore and rear sides and narrower left and right sides of a pack of cigarettes, respectively, and upper and lower extensions which are folded and form a top end closure and bottom end closure, respectively, when said inner wrapper is folded and filled with cigarettes to form a pack, said top end closure being composed of tucks which are the extensions of the narrower sides of said inner wrapper and flaps which are the extensions of the wider sides of said inner wrapper, dividing part being comprised of any one of said tucks of the inner wrapper and some parts of said flaps thereof which are enclosed by two vertical dividing lines and one horizontal dividing line of perforations or slits, said two vertical dividing lines being provided on each flaps and extending, perpendicular to the horizontal dividing line, from the upper end edge of said inner wrapper to the horizontal dividing line, respectively, such that said dividing lines are coincident with or adjacent to the end edge of the tuck when said tuck and flaps are folded and overlaid to form the top end closure, and said horizontal dividing line being parallel to and coincident with or adjacent to the upper horizontal fold line, and extending perpendicular to and between said vertical dividing lines, a rectangular outer wrapper having wider parts and narrower parts which will be placed on the wider fore and rear sides and narrower left and right sides of a pack of cigarettes, respectively, and upper and lower extensions which are folded and form a top end closure and bottom end closure, respectively, when said outer wrapper is folded and wraps a pack of cigarettes, said top end closure being composed of tucks which are the extensions of the narrower sides of said outer wrapper and flaps which are the extensions of the wider sides of said outer wrapper, a tear tape in the form of a narrow strip of polymeric material being attached to the inner side of said outer wrapper, in parallel with and spaced inwardly from one of horizontal end edges of said outer wrapper, a sealing strip of paper or polymeric material being attached, across the top end closure of said inner wrapper, to the upper end part of the middle wrapper; and a portion of adhesive having known nontoxic, tacky, cohesive properties, being provided between the inner surface of the tuck of the outer wrapper and the outer surface of the folded dividing part of the inner wrapper.

2. A soft pack of cigarettes being wrapped up with an inner metallic foil wrapper, a middle flexible paper wrapper, and an outer wrapper of transparent film of a polymeric material, comprising:

a rectangular inner metallic foil wrapper comprised of a layer of paper and metallic material layer, having wider parts and narrower parts which will be placed on the wider fore and rear sides and narrower left and right sides of a pack of cigarettes, respectively, and upper and lower extensions which are folded and form a top end closure and bottom end closure, respectively, when said inner wrapper is folded and filled with cigarettes to form a pack, said top end closure being composed of tucks which are the extensions of the narrower sides of said inner wrapper and flaps which are the extensions of the wider sides of said inner wrapper, dividing part being comprised of any one of said tucks of the inner wrapper and some parts of said flaps thereof which are enclosed by two vertical dividing lines and one horizontal dividing line of perforations or slits, said two vertical dividing lines being provided on each flaps and extending, perpendicular to the horizontal dividing line, from the upper end edge of said inner wrapper to the horizontal dividing line, respectively, such that said dividing lines are coincident with or adjacent to the end edge of the tuck when said tuck and flaps are folded and overlaid to form the top end closure, and said horizontal dividing line being parallel to and coincident with or adjacent to the upper horizontal fold line, and extending perpendicular to and between said vertical dividing lines, a rectangular outer wrapper having wider parts and narrower parts which will be placed on the wider fore and rear sides and narrower left and right sides of a pack of cigarettes, respectively, and upper and lower extensions which are folded and form a top end closure and bottom end closure, respectively, when said outer wrapper is folded and wraps a pack of cigarettes, said top end closure being composed of tucks which are the extensions of the narrower sides of said outer wrapper and flaps which are the extensions of the wider sides of said outer wrapper, a tear tape in the form of a narrow strip of a polymeric material being attached to the inner side of said outer wrapper, in parallel with and spaced inwardly from one of horizontal end edges of said outer wrapper, said tear tape, at any one of said narrower sides of said outer wrapper, being extended to the tuck part by means of extending means which connects the tear tape and said tuck part, said extending means being in the form of a short strip of polymeric material and being integrally adhered to the outer wrapper, the tear tape and the tuck part of the outer wrapper by heating, pressing and/or applying of bonding material, a sealing strip of paper or polymeric material being attached, across the top end closure of said inner wrapper, to the upper end part of the middle wrapper; and a portion of adhesive having known nontoxic, tacky, cohesive properties, being provided between the inner surface of the tuck of the outer wrapper and the outer surface of the folded dividing part of the inner wrapper.

3. A soft pack of cigarettes according to claim 1 or 2, wherein, the surface of said dividing part of the inner wrapper is formed to have no coating of metallic material applied thereto.

4. A soft pack of cigarettes according to claim 1 or 2, wherein, the factors that influence the removal of the top closure together with the dividing part from said soft pack of cigarettes are defined as follows;

adhering strength of the tear tape to the outer wrapper (herein designated as "T"), 2) tensile strength of the connecting part of the outer wrapper (herein designated as "O"), 3) the adhering strength of the adhesive applied between the foil surface of the inner wrapper and the inner surface of the outer wrapper (herein designated as "A"), 4) adhering strength of metallic foil layer on the surface of the paper layer comprising the inner wrapper to the paper layer of the inner wrapper (herein designated as "M"), 5) tensile strength of the dividing lines of the inner wrapper (herein designated as "D"), and said factors have the following interelationship among them;

$$T>O\geqq A\geqq M>D.$$

5. A soft pack of cigarettes according to claim 2, wherein, said extending means is comprised of a separate short strip or the tear tape itself.

6. A metallic foil wrapper sheet for being used as an inner wrapper for a soft pack of cigarettes, comprising:

a rectangular inner metallic foil wrapper comprised of a layer of paper and metallic material layer, having wider parts and narrower parts which will be placed on the wider fore and rear sides and narrower left and right sides of a pack of cigarettes, respectively, and upper and lower extensions which are folded and form a top end closure and bottom end closure, respectively, when said inner wrapper is folded and filled with cigarettes to form a pack, said upper extension being composed of tuck parts which are the extensions of the narrower sides of said inner wrapper and flap sections which are the extensions of the wider sides of said inner wrapper, dividing part being comprised of any one of said tucks of the wrapper sheet and some parts of said flaps thereof which are enclosed by two vertical dividing lines and one horizontal dividing line of perforations or slits, said two vertical dividing lines being provided on each flaps and extending, perpendicular to the horizontal dividing line, from the upper end edge of said wrapper sheet to the horizontal dividing line, respectively, such that said dividing lines are coincident with or adjacent to the end edge of the tuck when said tuck and flaps are folded and overlaid to form the top end closure, and said horizontal dividing line being parallel to and coincident with or adjacent to the upper horizontal fold line, and extending perpendicular to and between said vertical dividing lines; and the surface of said dividing part being formed to have no coating of metallic material applied thereto.

7. An outer wrapper for a soft pack of cigarettes, comprising;

a rectangular wrapper sheet having wider parts and narrower parts which, will be placed on the wider fore and rear sides and narrower left and right sides of a pack of cigarettes, respectively, and upper and lower extensions which are folded and form a top end closure and bottom end closure, respectively, when said outer wrapper is folded and wraps a pack of cigarettes, said upper extension being composed of tuck parts which are the extensions of the narrower sides of said outer wrapper and flap sections which are the extensions of the wider sides of said outer wrapper, a tear tape in the form of a narrow strip of a polymeric material being attached to the inner side of said wrapper sheet, in parallel with and spaced inwardly from one of horizontal end edges of said wrapper sheet; and said tear tape, at any one of said narrower sides of said outer wrapper, being extended to the tuck part by means of extending means which connects the tear tape and said tuck part, said extending means being in the form of a short strip of polymeric material and being integrally adhered to the outer wrapper, the tear tape and the tuck part of the outer wrapper by heating, pressing and/or applying of bonding material.

8. An outer wrapper for a soft pack of cigarettes according to claim 7, wherein, said extending means is comprised of a separate short strip or the tear tape itself.

9. An outer wrapper for a soft pack of cigarettes according to claim 7, wherein, a portion of adhesive having known nontoxic, tacky, cohesive properties is further provided on the inner side of said tuck on which said extending means is provided.

* * * * *